US007067977B2

(12) United States Patent
Kim

(10) Patent No.: US 7,067,977 B2
(45) Date of Patent: Jun. 27, 2006

(54) PLASMA DISPLAY PANEL AND DRIVING METHOD THEREOF

(75) Inventor: Jung-Hun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 334 days.

(21) Appl. No.: 10/405,353

(22) Filed: Apr. 3, 2003

(65) Prior Publication Data

US 2003/0189531 A1 Oct. 9, 2003

(30) Foreign Application Priority Data

Apr. 4, 2002 (KR) ..... 10-2002-0018562

(51) Int. Cl.
*H01J 17/49* (2006.01)

(52) U.S. Cl. ..... 313/582; 345/60

(58) Field of Classification Search ..... 313/582, 313/583, 584, 585, 586, 587, 590; 315/169.1, 315/169.3, 169.4; 345/60, 61, 37, 41, 67, 345/66, 55, 68, 84

See application file for complete search history.

(56) References Cited

U.S. PATENT DOCUMENTS

| | | | | |
|---|---|---|---|---|
| 6,806,645 | B1 * | 10/2004 | Choi | 313/582 |
| 6,815,890 | B1 * | 11/2004 | Tsai et al. | 313/584 |
| 6,873,103 | B1 * | 3/2005 | Takada et al. | 313/582 |
| 6,888,309 | B1 * | 5/2005 | Park et al. | 313/585 |
| 2003/0076037 | A1 * | 4/2003 | Choi | 313/582 |
| 2003/0098825 | A1 * | 5/2003 | Kim et al. | 345/63 |
| 2004/0169621 | A9 * | 9/2004 | Lee et al. | 345/60 |

* cited by examiner

*Primary Examiner*—Bipin Shalwala
*Assistant Examiner*—Nitin Patel
(74) *Attorney, Agent, or Firm*—Fleshner & Kim, LLP

(57) ABSTRACT

A plasma display panel (hereinafter, as PDP) and particularly, to a PDP and a driving method thereof, capable of performing efficient address discharge by generating a priming discharge in an address electrode which simultaneously shares upper and lower discharge cells in advance for a predetermined time before performing the address discharge. Therefore, mislighting and misdischarge of the address discharge can be prevented and the address voltage needed for the address discharge can be lowered.

8 Claims, 7 Drawing Sheets

PLASMA DISPLAY PANEL AND DRIVING METHOD THEREOF

BACKGROUND OF THE INVENTION

1. Field of the Invention

The present invention relates to a plasma display panel (hereinafter, as PDP) and particularly, to a PDP and a driving method thereof, capable of performing efficient address discharge by generating priming discharge in an address electrode simultaneously sharing upper and lower discharge cells.

2. Description of the Related Art

Generally, as the information processing system has increasingly developed and provided, the importance of the display apparatus as a visual information transmitting means is increased.

As a conventional display device, a Cathode Ray Tube (CRT) has a large volume, and distortion of image by an earth magnetic field is generated. Therefore, it does not fit for the current demands of scale-up, flatting, high luminance, and high efficiency of screens, and researches on various flat panel displays are actively progressed. For instance, a liquid crystal display (hereinafter, as LCD), a field emission display (hereinafter, as FED), a PDP and the like are actively developed as the flat display apparatus.

The PDP displays images including letters or graphics by light emission by ultraviolet rays generated in discharging inert mixed gas such as He+Xe, Ne+Xe, He+Ne+Xe and the like. On the other hand, such PDP can become easily thinner and larger and as the structure is simplified, fabrication is eased. Also, luminance and luminous efficiency is higher when compared with another flat panel display devices. Due to those advantages, researches on the PDP has been actively conducted. Particularly, in a 3-electrode alternating current surface discharge type PDP, since a dielectric layer covers an electrode, a wall charge is stored, and the electrodes are protected from sputtering generated by discharging, thus to enable low voltage driving and long life span.

FIG. 1 is a view showing the conventional 3-electrode surface discharge alternating current PDP (AC PDP).

As shown in FIG. 1, the discharge cells include a pair of sustain electrodes 12Y and 12Z formed on an upper substrate 10 and an address electrode 12X which is formed on a lower substrate 18.

The pair of sustain electrodes 12Y and 12Z are composed of a scan electrode 12Y and a sustain electrode 12Z. Also, the respective pair of sustain electrodes 12Y and 12Z includes a transparent electrode 12*a* and a bus electrode 12*b*.

On the upper substrate 10 in which the sustain electrodes 12Y and 12Z are formed, an upper dielectric layer 14 and a protection layer 16 are formed Here, upper dielectric layer 14 stores a wall charge generated during plasma discharge. Also, the protection layer prevents damage of the upper dielectric layer 14 by sputtering generated in plasma discharge, and improves discharging efficiency of the secondary battery. As the protection layer 16, MgO is commonly used.

A lower dielectric layer 22 for storing the wall charge is formed on the lower glass substrate 18 in which the address electrode 12X is formed. A barrier rib 24 is formed in the upper portion of the lower dielectric layer 22. On the surface of the lower dielectric layer 22 and the barrier rib 24, phosphor 20 is coated. Here, the barrier rib 24 prevents ultraviolet rays and visible rays from crosstalking with a neighboring discharge cell in plasma discharge. The phosphor 20 is excited by ultraviolet rays, thus to generate a visible ray among visible rays corresponding to R, G and B colors.

In the PDP barrier rib 24 is formed in a wall structure of a stripe form. However, in the stripe-type wall structure, exhaust of discharge gas is not easy and coating area of the phosphor 20 is small, thus to lowering luminance.

To solve the problem of the stripe-type barrier rib having the stripe type, a delta-type barrier rib structure was suggested.

FIG. 2 is a plan view showing a PDP having a general delta-type barrier rib.

As shown in FIG. 2, the PDP having the general delta-type barrier rib includes first and second bus electrodes 32Y and 32Z, first transparent electrode 34Y extended from the first bus electrode 32Y and a second transparent electrode 34Z extended from the second bus electrode 34Z. Here, the first transparent electrode 34Y and the first bus electrode 32Y are used as scan electrodes and the second transparent electrode 34Y and the first bus electrode 32Y are used as the scan electrode, and the second transparent electrode 34Z and the second bus electrode 32Z are used as the sustain electrode.

In addition, the delta-type barrier rib 42 includes a plurality of first barrier ribs 36 formed in parallel with the first bus electrode 32Y, and a second barrier rib 38 which is formed while being connected with the first barrier ribs 36 in a perpendicular direction. Here, sub pixels for displaying red, green and blue colors are arranged in a triangular shape by the delta-type barrier rib.

FIG. 3 is an exemplary view showing a structure of an address electrode of the PDP having the delta-type barrier rib shown in FIG. 2.

As shown in FIG. 3, the width of the address electrode 30 is widened in a part corresponding to a discharging space built by the delta-type barrier rib 42 in the PDP having the delta-type barrier rib 42, in the rest area, the width of the address electrode 30 is narrowly formed. Also, the part where the width of the address electrode 30 is positioned below the delta-type barrier rib, thus to prevent crosstalk with the neighboring cells.

FIG. 4 is an exemplary view showing a driving device of a general 3-electrode surface discharge AC PDP.

As shown in FIG. 4, the driving device of the 3-electrode surface discharge AC PDP includes a PDP 50 which is positioned in a matrix form so that mxn discharge cells 51 are connected with scan electrode lines Y1 to Ym, sustain electrode lines Z1 to Zm and address electrode lines X1 to Xn, scan/sustain driving units 52 for driving the scan electrode lines Y1 to Ym, a common sustain driving unit 54 for driving the sustain electrode lines Z1 to Zm, a first address driving unit 56A for driving address electrode lines of ordinal odd numbers X1, X3, . . . , Xn−3, Xn−1, and a second address driving unit 56B for driving address electrode lines of ordinal even numbers X2, X4, . . . , Xn−2, Xn.

Here, the scan/sustain driving unit 52 sequentially supplies scan pulses to the scan electrode lines Y1 to Ym. Also, the scan/sustain driving units 52 supplies sustain pulses to the scan electrode lines Y1 to Ym commonly. The common sustain driving unit 54 supplies sustain pulses to all of the sustain electrode lines Z1 to Zm.

The first and second address driving units 56A and 56B supplies data pulses to the address electrode lines X1 to Xn to be synchronized with the scan pulse. That is, the first address driving unit 56A supplies data pulses to the address electrode lines of ordinal odd numbers X1, X3, . . . , Xn−3, Xn−1, and a second address driving unit 56B supplies data pulses to the address electrode lines of ordinal even numbers X2, X4, . . . , Xn−2, Xn.

FIG. 5 is an exemplary view showing a frame of a general PDP.

As shown in FIG. 5, the PDP is driven by dividing a frame into many sub-fields with different number of discharging to indicate a gray level. The respective sub-field is divided into a reset period for uniformly generating discharging (that is, for uniformly forming the wall charge of the entire cells), an address period for selecting the discharge cells (that is, for forming wall charges in cells of particular position) and a sustain period for indicating the gray scale according to the discharging times.

For instance, in case of displaying images with 256 gray scales, a frame period (16.67 ms) corresponding to 1/60 second (called as '1TV field') is divided into 5 to 8 sub-fields (that is, SF1 to SF8). In addition, the 8 sub-fields are classified into a reset period, an address period and a sustain period again. Here, the reset period and the address period of the respective sub-fields are identical in respective sub-fields and on the other hand, the sustain period is increased at a ratio of $2^n$ in the respective sub-fields.

FIG. 6 is a wave form showing a driving method of a general 3-electrode surface discharge AC PDP.

As shown in FIG. 6, a sub-field is divided into a reset period for initializing an entire screen, an address period for subscribing data while scanning the entire screen by a sequential method and an elimination period for eliminating the sustain period and sustain discharge for maintaining radiated status of the cells in which the data is subscribed.

This will be described as follows.

Firstly, reset pulse (RP) is supplied to the scan electrode lines Y1 to Ym in the reset period. When the reset pulse (RP) is supplied to the scan electrode lines Y1 to Ym, reset discharge is generated between the scan electrode lines Y1 to Ym and the sustain electrode lines Z1 to Zm, thus to initialize the discharge cell.

The scan pulse SP is sequentially applied to the scan electrode lines Y1 to Ym in the address period. Also, the data pulse DP which is synchronized with the scan pulse SP is applied to the address electrode lines X1 to Xn. At this time, address discharge is generated in the discharge cells to which the data pulse DP and scan pulse SP are applied.

First and second sustain pulses SUSPy and SUSPz are supplied to the scan electrode lines Y1 to Ym and sustain electrode lines Z1 to Zm. At this time, sustain discharge is generated in the discharge cells in which the address discharge is generated.

In the elimination period, the elimination pulse EP is supplied to the sustain electrode lines Z1 to Zm. When the elimination pulse EP is supplied to the sustain electrode lines Z1 to Zm, the sustain discharge is eliminated.

On the other hand, to stably maintain plasma discharge, lengths of the scan electrode and sustain electrode must be maintained at a proper level. However, the driving method of the PDP can not efficiently generate discharge since the lengths of the scan electrode lines Y1 to Ym and sustain electrode lines Z1 to Zm are short. In other words, as the resolution of the PDP panel is increased, the size of the discharge cell is decreased, the length to the upper and lower directions becomes shorter than that of the discharge cell including the delta-type barrier rib, and accordingly, a discharging path between the scan electrode lines Y1 to Ym and sustain electrode lines Z1 to Zm facing each other in the orthogonal direction with the address electrode becomes shorter. Therefore, as the resolution of the PDP increases, the driving voltage is increased but the luminance decreases. Also, as the resolution of the PDP panel increases, the number of the scan and sustain electrode lines is increased, and the scanning time for scanning the respective lines is reduced, thus to generate mislighting or misdischarge phenomenon of address discharge.

SUMMARY OF THE INVENTION

Therefore, an object of the present invention is to provide a plasma display panel (hereinafter, as PDP) and a driving method thereof, capable of preventing mislighting and misdischarge of the address discharge by generating priming discharge in an address electrode which simultaneously shares upper and lower discharge cells before performing the address discharge and lowering an address voltage needed for the address discharge.

To achieve these and other advantages and in accordance with the purpose of the present invention, as embodied and broadly described herein, there is provided a PDP in which a plurality of address electrodes are installed in the discharge cell and one of the address electrode is formed to be shared with the discharge cells neighboring in the upper and lower directions.

To achieve these and other advantages and in accordance with the purpose of the present invention, as embodied and broadly described herein, there is provided a driving method of a PDP, including a step of generating priming discharge by simultaneously supplying an address voltage to discharge cells neighboring in the upper and lower directions for a predetermined time before performing the address discharge.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
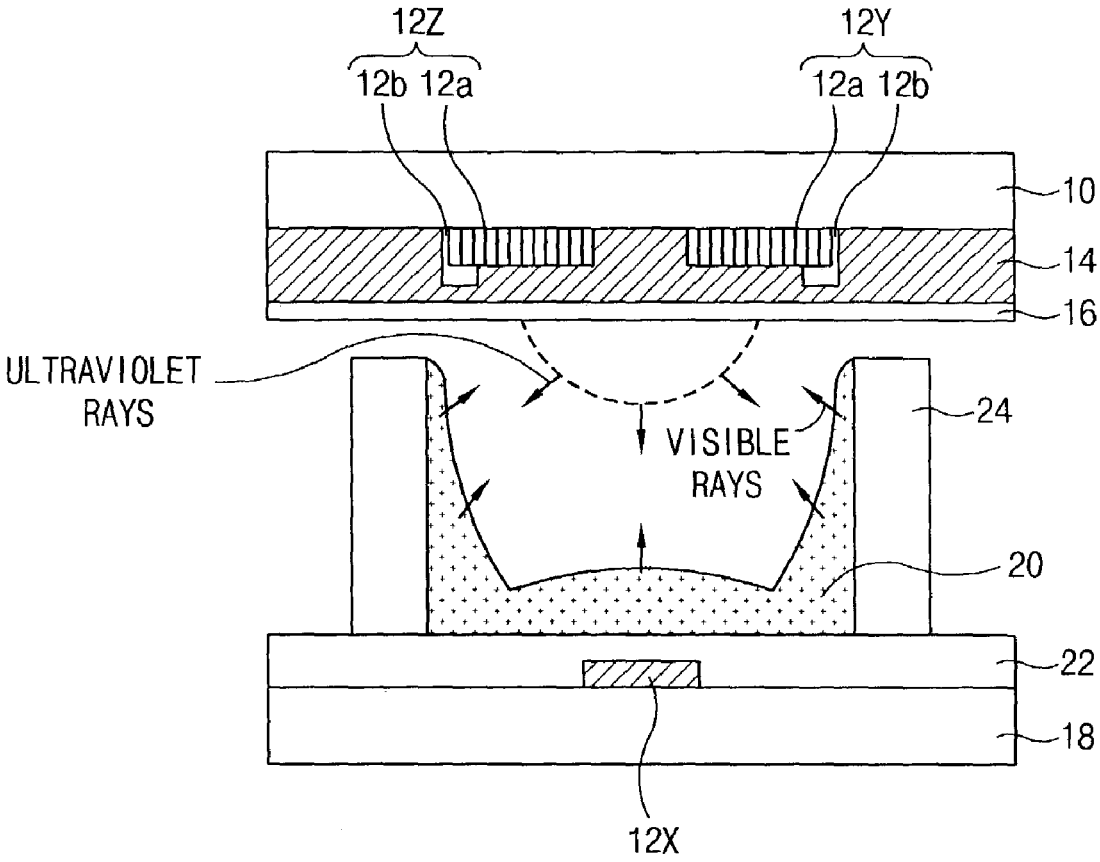
FIG. 1 RELATED ART
FIG. 1 is a view showing the conventional 3-electrode surface discharge alternating current plasma display panel (AC PDP)
Figure 2:
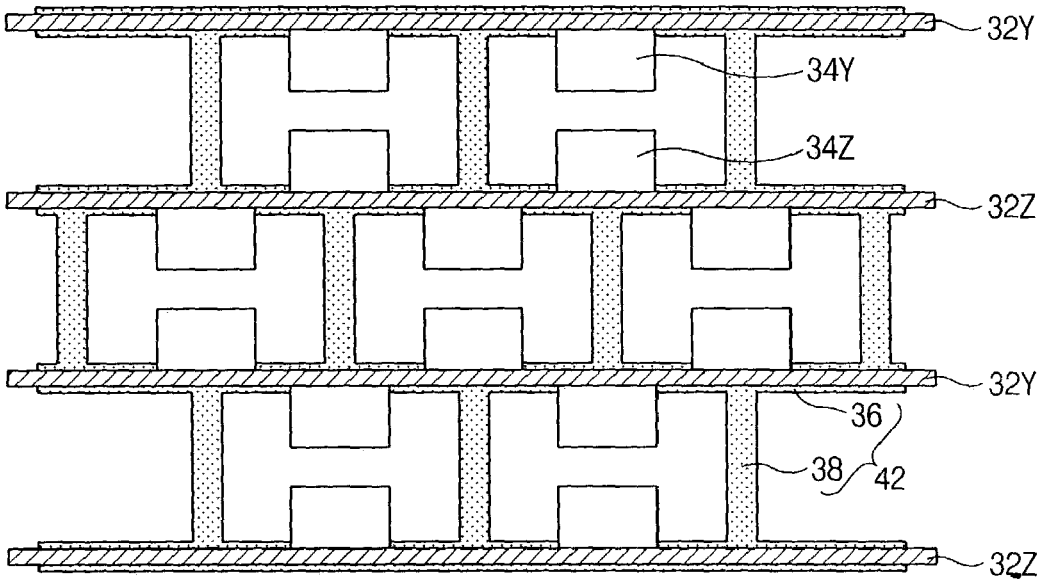
FIG. 2 RELATED ART
FIG. 2 is a plan view showing a PDP having a general delta-type barrier rib.
Figure 3:
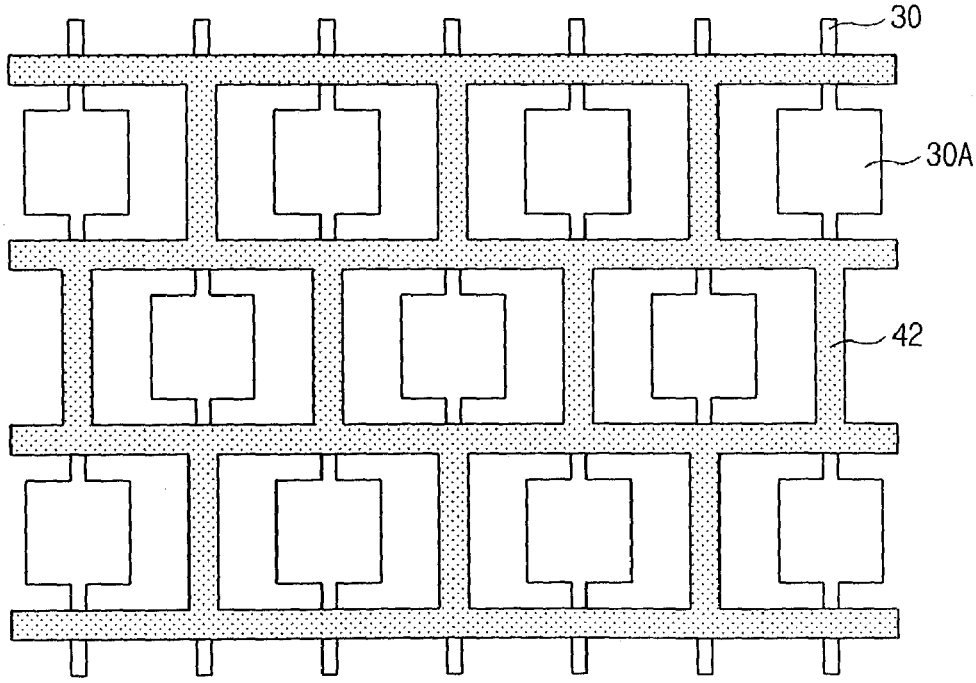
FIG. 3 RELATED ART
FIG. 3 is an exemplary view showing a structure of an address electrode of the PDP having the delta-type barrier rib shown in FIG. 2.
Figure 4:
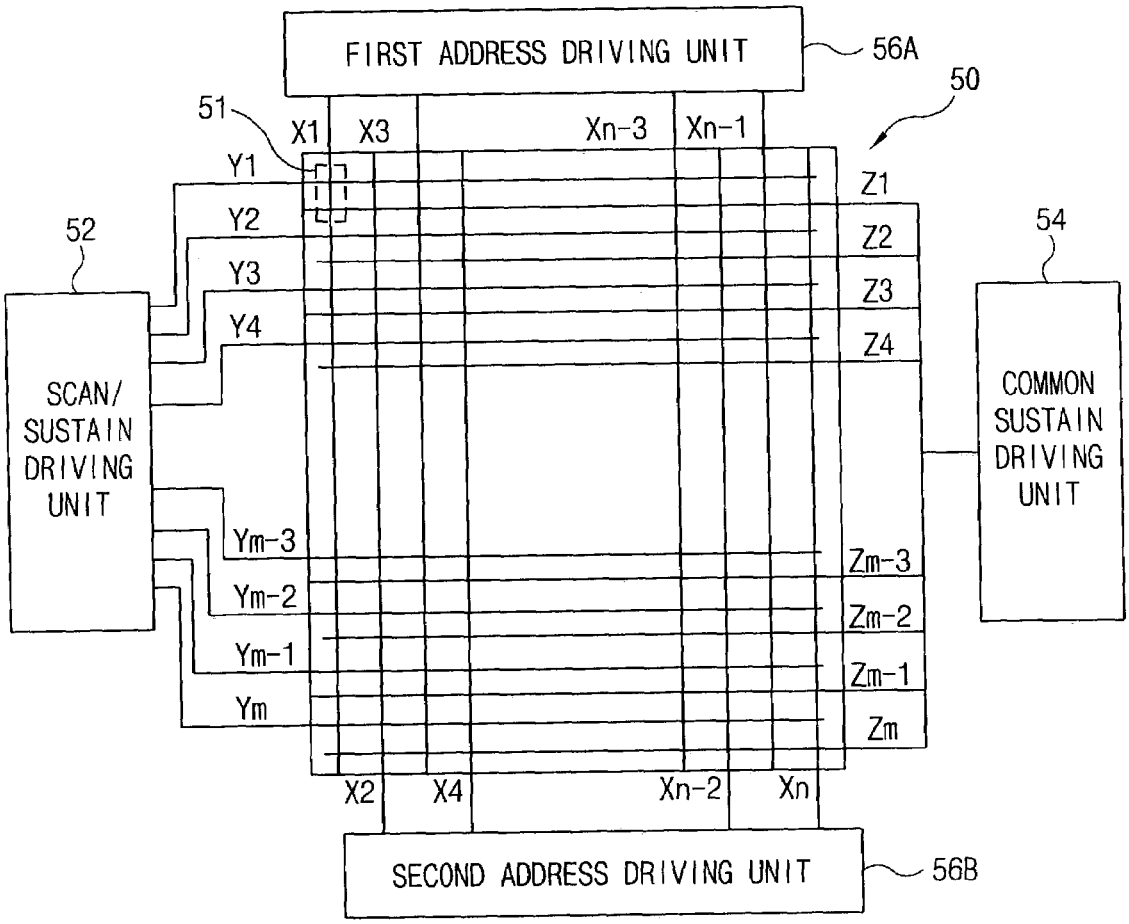
FIG. 4 RELATED ART
FIG. 4 is an exemplary view showing a driving device of a general 3-electrode surface discharge AC PDP.
Figure 5:
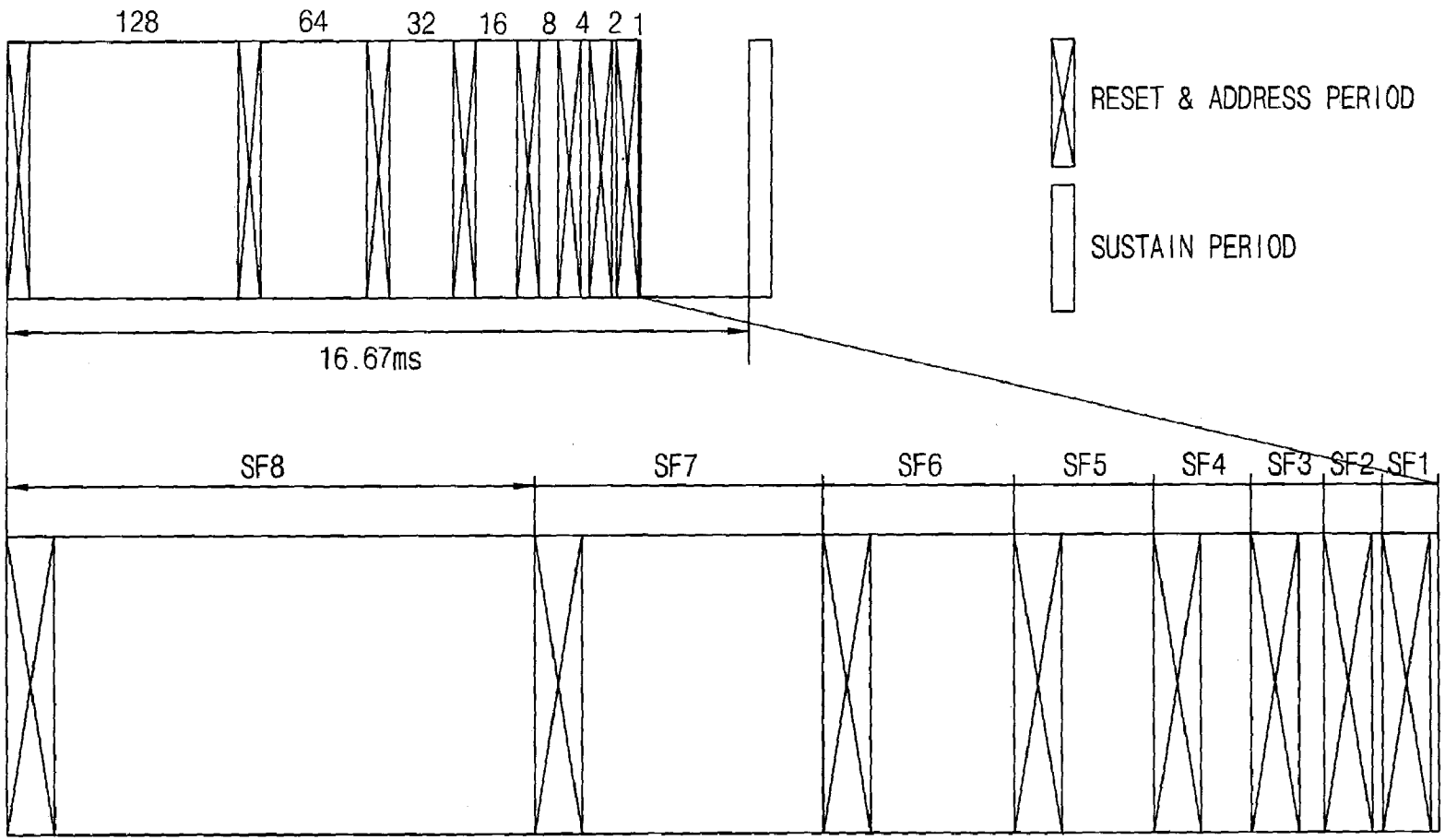
FIG. 5 RELATED ART
FIG. 5 is an exemplary view showing a frame of a general PDP.
Figure 6:
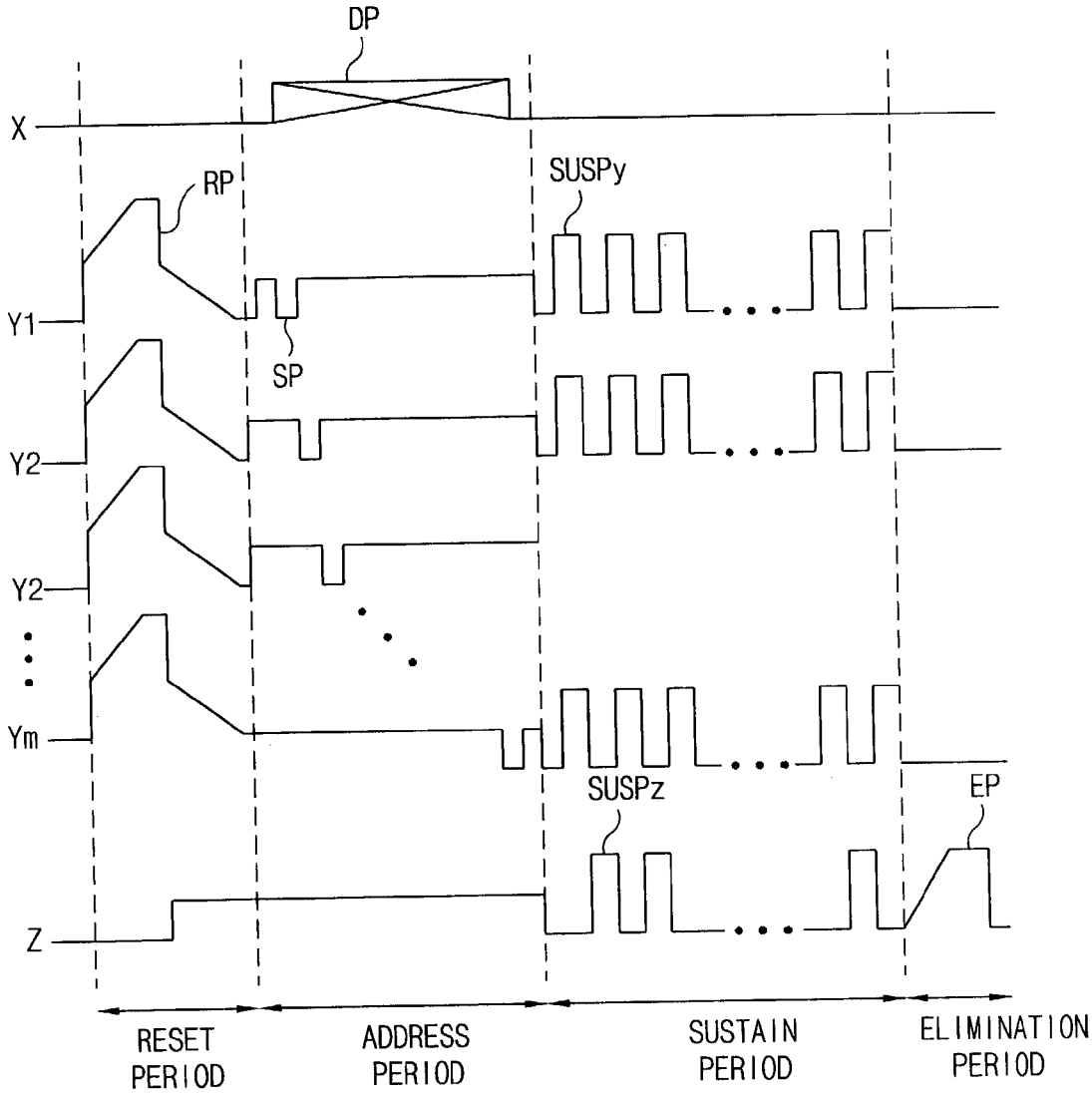
FIG. 6 RELATED ART
FIG. 6 is a wave form showing a driving method of a general 3-electrode surface discharge AC PDP.
Figure 7:
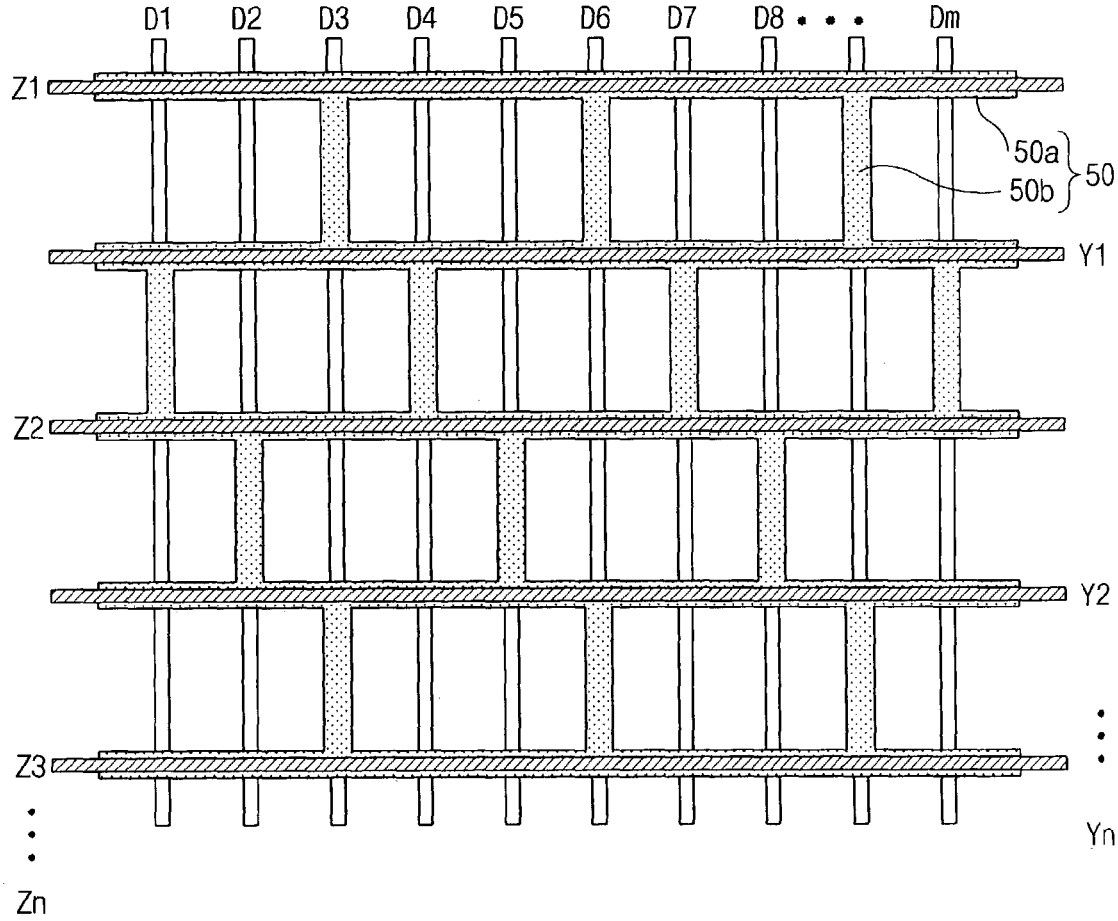
FIG. 7 is a plan view showing a PDP including an address electrode in accordance with an embodiment of the present invention.

FIG. 7 is a plan view showing a plasma display panel (hereinafter, as PDP) including an address electrode in accordance with an embodiment of the present invention.

As shown in FIG. 7, scan electrodes Y1 to Yn which are formed to cross with address electrodes D1 to Dm and sustain electrodes Z1 to Zn on an upper surface of the PDP in accordance with the present invention. A scan pulse for scanning a panel and a sustain pulse for maintaining discharge are supplied to the scan electrodes Y1 to Yn and the sustain pulse is supplied to the sustain electrodes Z1 to Zn.

On the lower plate of the PDP, a delta-type barrier rib 50 in which the upper and lower discharge cells are positioned crossing each other as ⅓ point of the breadthwise length of the discharge cell, and two address electrodes D1 to Dm for generating the address discharge and priming discharge are built. That is, two address electrodes among the address electrodes D1 to Dm are positioned in a discharge cell, and one of the electrodes is shared with discharge cells neighboring in the upper and lower directions. A priming voltage is applied to the address electrode shared with the discharge cells neighboring in the upper and lower directions for a predetermined time right before the address period and thereby generating the priming discharge. In addition, the address discharge is generated by applying the address voltage to the rest address electrodes which are not shared for the address period.

An embodiment on the priming discharge and address discharge will be described as follows.

In case the scan pulse is supplied to the first scan electrode Y1, the second, fifth, eighth . . . address electrodes D2, D5, D8, . . . which are shared with the upper and lower discharge cells on the basis of the first scan electrode Y1 are used in priming discharge generated before the address discharge. Also, the first, fourth, seventh . . . address electrodes D1, D4, D7, . . . which are positioned in the upper part on the basis of the first scan electrode Y1 and are not shared are used in generating the address discharge of the upper discharge cell, and the third, sixth, ninth . . . address electrodes D3, D6, D9, . . . which are positioned in the lower part on the basis of the first scan electrode Y1 and are not shared are used in generating the address discharge of the lower discharge cell.

The delta-type barrier rib 50 includes a first barrier rib 50*a* which is formed in parallel with the scan and sustain electrodes and a second barrier rib 50*b* which is formed to be crossed with the first barrier rib 50*a* to be connected with the first barrier rib 50*a* in the upper and lower directions. Here, the second barrier rib 50*b* is formed at a ⅓ point of the breadthwise length of the first barrier rib 50*a* in the discharge cell. Also, one D2 of the two address electrodes (for instance, D1 and D2) formed in the discharge cell is shared in the upper and lower neighboring cell. Accordingly, the red, green and blue sub pixels composing the discharge cell are arranged in a triangular shape by the delta-type barrier rib 50.

On the other hand, the address electrodes can be formed so that the areas of the two address electrodes are differently formed. For instance, the address electrode is formed to have a wider width at a position corresponding to the discharge space built by the delta-type barrier rib and the width of the address electrode can be narrowly formed in the rest region.

Figure 8:
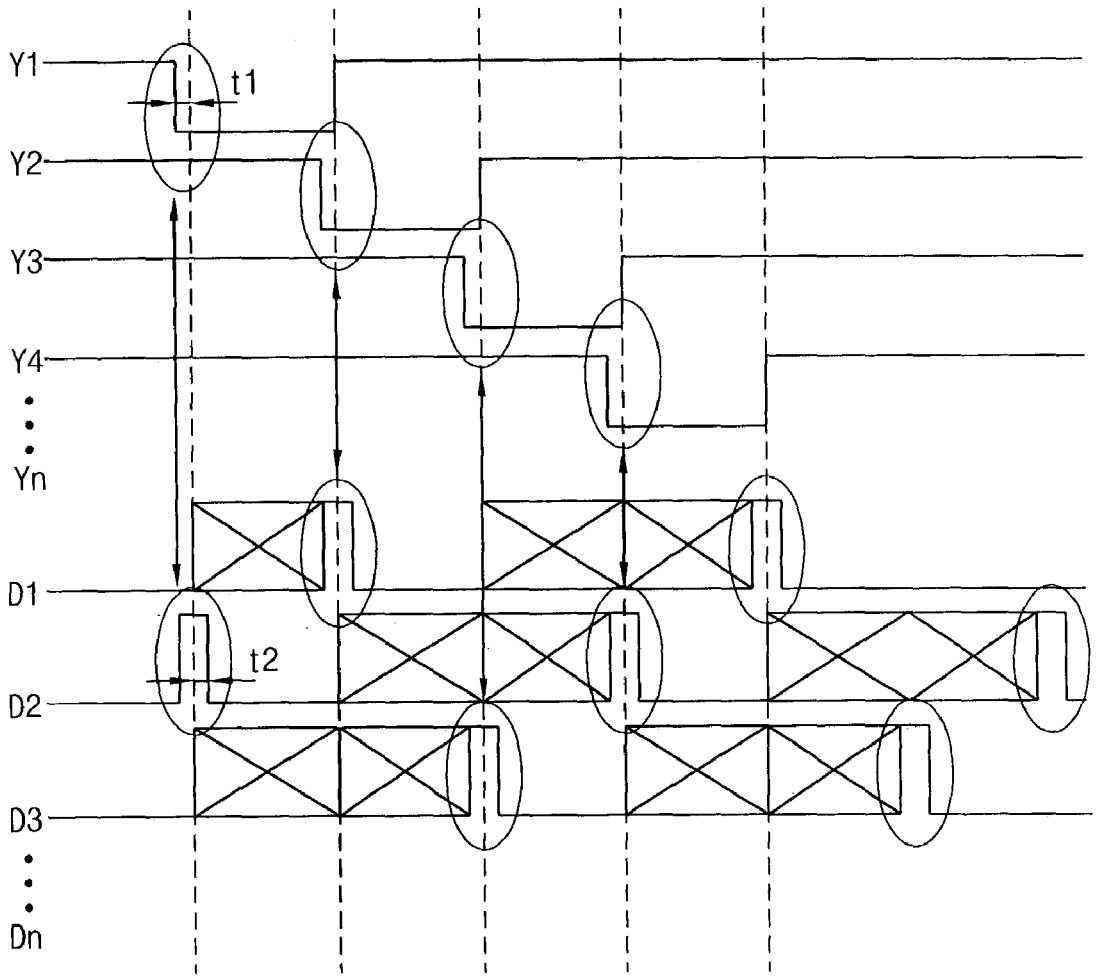
FIG. 8 shows a driving wave form supplied for the address period in accordance with the embodiment of the present invention.

FIG. 8 shows a driving wave form supplied for the address period in accordance with the embodiment of the present invention.

As shown in FIG. 8, the scan pulse is supplied to the scan electrode lines Y1 to Yn a priming time t1 before the time when the scan pulse electrode lines Y1 to Yn are selected. Accordingly, the priming discharge is generated for the priming time t1 before the address discharge. The priming discharge is generated among the scan electrodes shared with the upper and lower neighboring cells among the scan electrode lines Y1 to Yn and the address electrodes D1 to Dm.

The scan electrode lines which satisfy n=3k (k is a natural number of 0 or higher) among the scan electrode lines Y1 to Yn generate a priming discharge with the address electrodes which satisfy m=3k (k is a natural number of 0 or higher) among the address electrodes D1 to Dm. Also, the scan electrode lines which satisfy n=3k+1 (k is a natural number of 0 or higher) among the scan electrode lines Y1 to Yn generate a priming discharge with the address electrodes which satisfy m=3k+2 (k is a natural number of 0 or higher) among the address electrodes D1 to Dm. In the same way, the scan electrode lines which satisfy n=3k+2 (k is a natural number of 0 or higher) among the scan electrode lines Y1 to Yn generate a priming discharge with the address electrodes which satisfy m=3k+1 (k is a natural number of 0 or higher) among the address electrodes D1 to Dm.

For instance, in the priming discharge, the first scan electrode Y1 generates discharge with the second, fifth, eighth . . . address electrodes D2, D5, D8, . . . in case the first scan electrode Y1 is selected and the second scan electrode Y2 generates discharge with the first, fourth, seventh . . . address electrodes D1, D4, D7, . . . in case the first scan electrode Y2 is selected.

On the other hand, the address discharge is generated by applying the data pulse to the address electrode lines so that the data pulse is synchronized with another scan pulse which is not an electrode that generates the priming discharge in the discharge cell. At this time, to maintain the address discharge, the address voltage is supplied to the address electrodes for the second time t2. In case the second time t2 is short, mislighting can be generated, and on the other hand, in case the second time t2 is too long, the address electrodes can generate mislighting. Therefore, the address discharge can be generated by properly setting the second time t2 that the address voltage is supplied. The time for maintaining the priming time t1 in accordance with the present invention and the address voltage is commonly selected in a range of 100~500 nsec. Accordingly, the time needed for the address discharge is shortened, thus to reduce the probability of the mislighting or mischarge. Also, by generating the priming discharge in advance, the address voltage needed to the address discharge can be lowered.

As described above, the PDP and the driving method thereof in accordance with the present invention can generate the priming discharge before performing the address discharge by installing a plurality of address electrodes in the discharge cell and composing one of the address electrodes to be shared with the upper and lower neighboring discharge cells. Therefore, mislighting and misdischarge of the address discharge can be prevented and the address voltage needed for the address discharge can be lowered.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A plasma display panel including a scan electrode and an address electrode for generating address discharge, wherein the address electrodes are formed in a discharge cell as plural, and one of the address electrodes is shared with a discharge cell which neighbors in the upper direction or lower direction.

2. The panel of claim 1, wherein two address electrodes are formed in the discharge cell and one of the electrodes is shared with discharge cell neighboring in the upper and lower directions.

3. The panel of claim 2, wherein the address electrode is not synchronized with a scan electrode which generates priming discharge in the discharge cell but with another scan electrode and forms a wall charge in the discharge cell.

4. The panel of claim 3, wherein the discharge cell is arranged in a delta form and red, green and blue phosphors are respectively coated thereon.

5. The panel of claim 1, wherein a delta-type barrier rib and the width of the address electrode is widely formed in a portion corresponding to the discharge space built by the delta-type barrier rib, and the width of the address electrode is narrowly formed in the rest region.

6. The panel of claim 1, wherein the discharge cells neighboring in the upper and lower directions include delta-type barrier ribs which are positioned crossing each other at a predetermined length.

7. The panel of claim 6, wherein the delta-type barrier rib includes:

a first barrier rib formed in a direction parallel to the scan electrode; and a second barrier rib which is formed to be connected with the first barrier rib in a crossing direction with the barrier rib to mutually separate the discharge cell.

8. The panel of claim 7, wherein the second barrier rib is formed to be connected with the first barrier rib in a crossing direction with the barrier rib to mutually separate the discharge cell and the crossing point is formed at a ⅓ point of the length of the first barrier rib corresponding to the width size of the discharge cell.

* * * * *